US006397950B1

(12) United States Patent
Streich et al.

(10) Patent No.: US 6,397,950 B1
(45) Date of Patent: Jun. 4, 2002

(54) APPARATUS AND METHOD FOR REMOVING A FRANGIBLE RUPTURE DISC OR OTHER FRANGIBLE DEVICE FROM A WELLBORE CASING

(75) Inventors: Steven G. Streich, Duncan; James C. Tucker, Springer, both of OK (US); James R. Birchak; Paul F. Rodney, both of Spring, TX (US); Neal G. Skinner, Lewisville, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/628,535

(22) Filed: Jul. 31, 2000

Related U.S. Application Data

(63) Continuation-in-part of application No. 08/976,320, filed on Nov. 21, 1997, now Pat. No. 6,095,247.

(51) Int. Cl.[7] ..... E21B 29/02

(52) U.S. Cl. ..... 166/376; 166/55; 166/63; 166/65.1; 166/177.2; 166/296; 166/299

(58) Field of Search ..... 166/299, 317, 166/376, 296, 297, 55, 63, 249, 177.1, 177.2, 65.1

(56) References Cited

U.S. PATENT DOCUMENTS

| | | | | | |
|---|---|---|---|---|---|
| 4,306,628 | A | * | 12/1981 | Adams et al. | 175/4.56 |
| 4,790,385 | A | * | 12/1988 | McClure et al. | 166/299 |
| 5,131,472 | A | * | 7/1992 | Dees et al. | 166/308 |
| 5,622,211 | A | * | 4/1997 | Martin et al. | 166/296 X |
| 6,095,247 | A | * | 8/2000 | Streich et al. | 166/299 |
| 6,237,688 | B1 | * | 4/2001 | Burleson et al. | 166/281 |

* cited by examiner

*Primary Examiner*—William Neuder
*Assistant Examiner*—John Kreck
(74) *Attorney, Agent, or Firm*—John W. Wustenberg; Neal R. Kennedy

(57) ABSTRACT

An apparatus and method for removing a frangible rupture disc or other frangible device from a wellbore casing. The casing has a special casing section defining a plurality of holes therethrough. Rupturable glass ceramic discs or inserts are disposed in the holes and retained therein. The glass ceramic discs or inserts are adapted to withstand fluid differential pressure normally present in the wellbore but are rupturable in response to impingement by a pressure wave thereon. The pressure wave is provided by a pressure wave generating device positionable in the casing string adjacent to the holes in the special casing section. The pressure generative device may generate a pressure pulse or an acoustical wave. Methods of perforating a well casing using a pressure pulse or an acoustical wave are also disclosed.

31 Claims, 4 Drawing Sheets

APPARATUS AND METHOD FOR REMOVING A FRANGIBLE RUPTURE DISC OR OTHER FRANGIBLE DEVICE FROM A WELLBORE CASING

This is a continuation-in-part of U.S. patent application Ser. No. 08/976,320, filed Nov. 21, 1997 now U.S. Pat. No. 6,095,247.

FIELD OF THE INVENTION

This invention relates to apparatus and methods for opening perforations in well casings, and more particularly, to a casing section having a plurality of holes plugged with ceramic rupture discs, inserts or other frangible devices which can be ruptured by an acoustical or pressure wave from inside the well casing.

DESCRIPTION OF THE PRIOR ART

In the completion of oil and gas wells, it is a common practice to cement a casing string or liner in a wellbore and to perforate the casing string at a location adjacent to the oil or gas containing formation to open the formation into fluid communication with the inside of the casing string. To carry out this perforating procedure, numerous perforating devices have been developed which direct an explosive charge to penetrate the casing, the cement outside the casing and the formation.

In many instances in the completion and service of oil and gas wells, it is desirable to have a method and apparatus whereby perforations can be opened in the well casing string without penetrating the various layers of cement, resin-coated sand or other material located around the exterior of the casing string. Also, in some instances, it is desirable to isolate sections of the well casing such that the sections do not have cement or other materials around the exterior of the isolated section. That is, there is cement above and below a casing section but not around it, which leaves an open annulus between the casing and the wellbore and associated formation. It may further be desirable to penetrate such a section without the perforation penetrating the formation itself.

The present invention provides an apparatus and method for carrying out such procedures by utilizing a casing section which is plugged with ceramic discs, inserts or other frangible devices which can be ruptured by an acoustical or pressure wave within the well casing. In some embodiments, this pressure wave is produced by a small explosive charge detonated within the well casing. In others, the pressure wave is suddenly applied in the casing string, or acoustical wave generating devices are utilized.

SUMMARY OF THE INVENTION

The present invention includes an apparatus for opening perforations in a casing string by removing frangible rupture discs or other frangible devices in a casing string disposed in a wellbore and also relates to methods of perforating using this or similar apparatus.

The apparatus comprises a casing string positionable in the wellbore, the casing string itself comprising a casing section defining a plurality of holes through a wall thereof. The apparatus further comprises a rupturable plug means disposed in each of the holes in the casing section for rupturing in response to an impingement by a pressure wave, and a pressure wave generating device for generating the wave. The pressure wave generating device is separate from the casing string and positionable therein after the casing string is positioned in the wellbore. The rupturable plug means is preferably characterized by a disc or insert made of a glass ceramic material which will withstand differential pressures thereacross but will fracture in response to impingement by the pressure wave.

The apparatus further comprises retaining means for retaining the inserts in the holes prior to the rupture of the inserts. The retaining means may comprise a shoulder in each of the holes for preventing radially inward movement of the inserts. The retaining means may also comprise a retainer ring disposed in each of the holes for preventing radially outward movement of the inserts. In another embodiment, the retaining rings may comprise an adhesive disposed between the inserts and a portion of the casing string defining the holes. In an additional embodiment, the retaining rings may comprise a backup ring threadingly engaged with each of the holes for preventing radial outward movement of the inserts. In still another embodiment, the retaining rings may comprise a case threadingly engaged with each of the holes and defining an opening therein, wherein each of the inserts is disposed in one of the openings in a corresponding case.

The apparatus may further comprise a sealing means for sealing between the inserts and the casing string section. The sealing means may be characterized by a sealing element, such as an O-ring, or may include the adhesive previously described.

In one embodiment, the wave generating device is positionable in the casing string adjacent to the plug means on a length of fluid-filled tubing. The wave generating device may be a negative pulser, a coil tubing collar locator or a pressure pulse generator. The wave generating device may also be an acoustic wave generating device so that the pressure wave is an acoustic wave. In one embodiment, the acoustic wave generating device is an acoustical horn.

The invention also includes a method of opening perforations in a well casing without damaging areas outside the well casing. This method comprises the steps of providing a casing string in a wellbore wherein the casing string has a section defining a plurality of rupturably plugged holes therein, positioning a wave generating device in the casing string adjacent to the holes, and generating a pressure wave with the wave generating device such that the pressure wave impinges on the plugged holes and ruptures and unplugs the holes. The step of providing a casing string may comprise plugging the holes with a glass ceramic material which will rupture in response to impingement by the pressure wave.

The step of providing the casing string may also comprise filling the section of the casing string with a fluid, most often a liquid such as salt water, brine or a hydrocarbon liquid, for transmitting the pressure wave therethrough. In this embodiment, the method may further comprise the step of pressurizing the fluid in the casing string prior to the step of generating the pressure wave.

In a preferred embodiment, the step of positioning the wave generating device in the method comprises connecting the wave generating device to a length of coil tubing, and positioning the device in the well using the tubing. This may also comprise filling the tubing with fluid. The wave generating device may be a negative pulser, a coil tubing collar locator or a pressure pulse generator.

In another embodiment, the wave generating device may be an acoustic wave generating device, and the pressure wave is an acoustic wave. The acoustic wave generating device may include an acoustical horn. The acoustical horn may be positioned in fluid in the casing section. The horn may be adapted to generate an acoustical wave sufficient to place frangible material plugging the holes in a resonant state such that the frangible material shatters.

In other embodiments of the invention, the pressure wave may be generated by a mild explosive force. Thus, the apparatus may also be described as comprising a casing string positionable in the wellbore, the casing string itself comprising a casing section defining a plurality of holes through a wall thereof. The apparatus further comprises a rupturable plug means disposed in each of the holes in the casing section for rupturing in response to impact by the mild explosive force, and explosive means for generating the explosive force in the casing section adjacent to the holes. The explosive force fractures the rupturable plug means and thereby opens the holes so that an inner portion of the casing string is placed in communication with an outer portion thereof. The rupturable plug means is preferably characterized by a disc or insert made of a ceramic material which will withstand differential pressures thereacross but will fracture in response to impact by the explosive force.

The explosive means may be characterized by a length of det-cord disposed along the longitudinal center line of the casing section. The det-cord preferably comprises an explosive present in the amount of about forty grams per foot to about eighty grams per foot, but additional types of det-cord or other explosive means may also be suitable.

The apparatus may be further described as a method for opening perforations in a well casing comprising the steps of providing a casing string in the wellbore, wherein the casing string has a section defining a plurality of plugged holes therein, and detonating an explosive charge in the casing string adjacent to the holes and thereby unplugging the holes. The step of providing the casing string preferably comprises plugging the holes with a ceramic material which will rupture in response to detonation of the explosive charge.

This method of the invention may further comprise, prior to the step of detonating, a step of isolating the section of the casing string by placing material above and below the section of the casing string in a wellbore annulus defined between the casing string and the wellbore. In one embodiment, the step of placing comprises cementing the well annulus above and below the section of the plugged casing string section.

This method also comprises placing the explosive charge in the well casing in the form of a portion of det-cord. Preferably, the det-cord is placed on the longitudinal center line of the casing string.

Numerous objects and advantages of the invention will become apparent to those skilled in the art when the following detailed description of the preferred embodiment is read in conjunction with the drawings which illustrate such embodiment.

BRIEF DESCRIPTION OF THE DRAWINGS

FIG. 9 illustrates the apparatus for opening perforations in a casing string using an acoustic wave.

FIG. 10 is an enlargement of a portion of FIG. 9.

DESCRIPTION OF THE PREFERRED EMBODIMENT

FIGS. 1–8 illustrate the present invention in which an explosive charge, such as from detonation cord, is used to produce a pressure wave to remove frangible rupture discs from the wall of a wellbore casing.

FIGS. 9 and 10 illustrate an alternate method in which an acoustical or pressure wave is generated either from the surface or at a point adjacent to the disc by means other than an explosive means.

Figure 1:
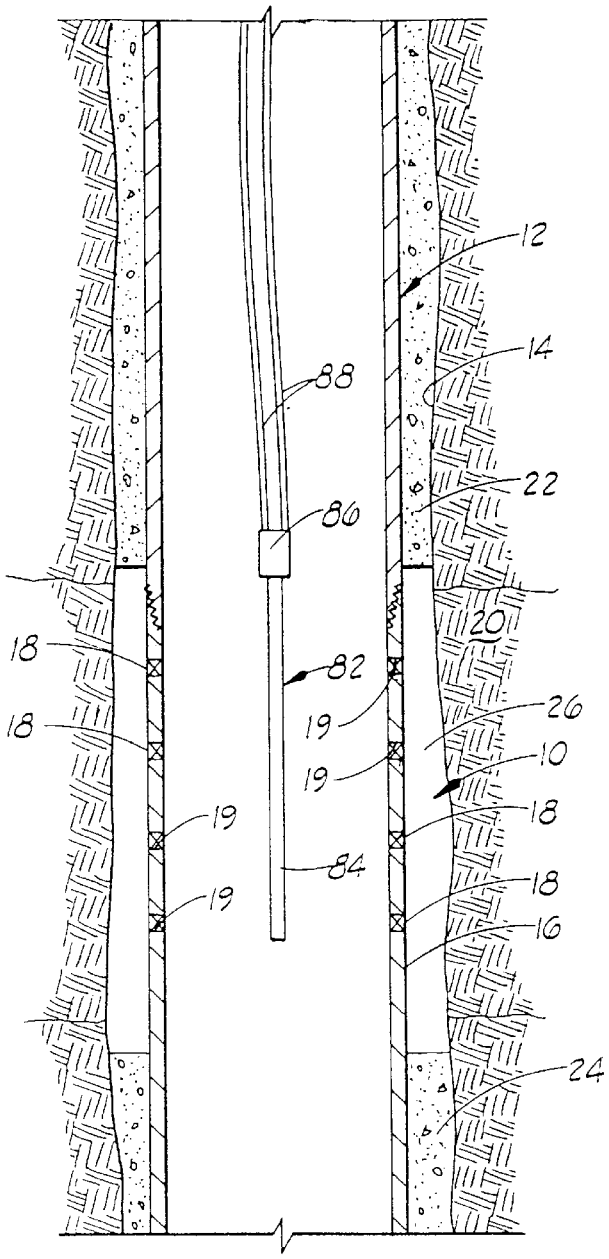
FIG. 1 illustrates an apparatus for opening perforations by removing a frangible rupture disc or other frangible device in the well casing string embodied as a plug in the casing string section positioned in a wellbore and using an explosive charge to open the casing string.

Referring specifically to the drawings illustrating the different embodiments, and more particularly to FIG. 1, an apparatus for opening perforations in a casing string of the present invention using an explosive charge is shown and generally designated by the numeral 10. Apparatus 10 comprises a casing string 12 disposed in a wellbore 14.

Casing string 12 itself comprises a special casing string section 16 having a plurality of rupturable plug means 18 disposed in holes 19 in section 16. Section 16 is positioned in wellbore 14 such that rupturable plug means 18 are generally adjacent to a well formation 20. The present invention may be used in a gravel pack application in which gravel pack material has been placed outside of the casing. The gravel pack material must not be damaged or penetrated in any manner as when conducting normal perforating operations with shaped charges to open holes in the casing. A gravel pack application is illustrated in FIG. 9 but could also be used with the apparatus embodiment shown in FIGS. 1–8.

In the illustrated embodiment of FIG. 1, an upper column of cement 22 is disposed above rupturable plug means 18 and in the annulus between the casing string 12 and wellbore 14. Similarly, a lower column of cement 24 is disposed in the well annulus below rupturable plug means 18. That is, in the illustrated position of apparatus 10, a generally open annulus 26 is defined between section 16 and well formation 20. Annulus 26 is bounded at its upper end by upper cement column 22 and at its lower end by lower cement column 24.

Figure 2:
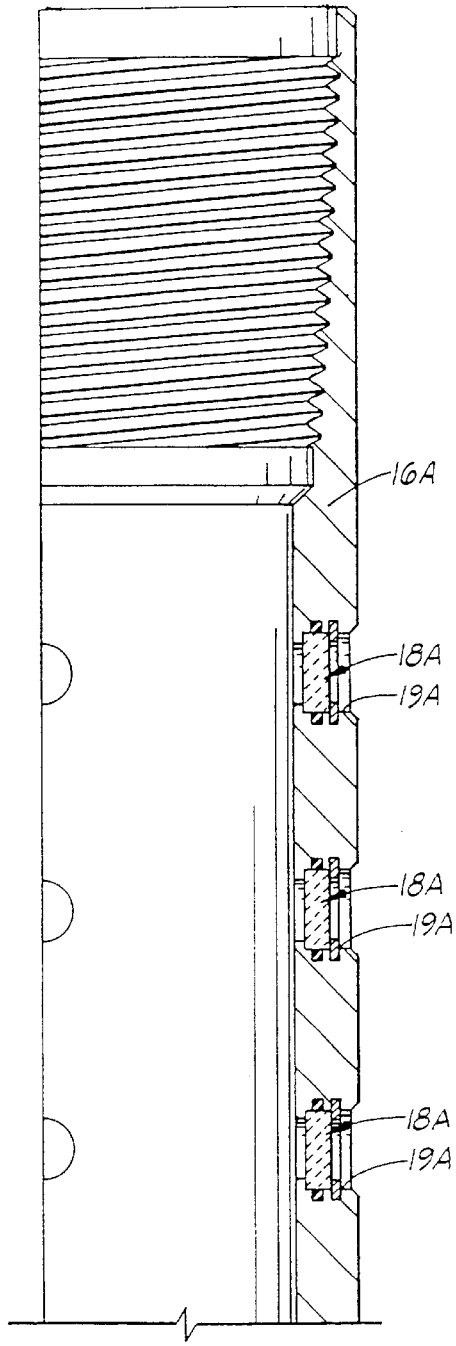
FIG. 2 shows a longitudinal cross-section of a first preferred embodiment of the casing string section.
Figure 3:
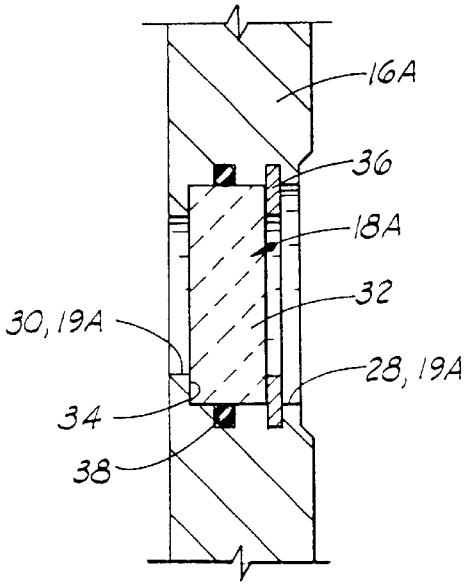
FIG. 3 is an enlargement of FIG. 2.

Referring now to FIGS. 2 and 3, a first embodiment of the apparatus will be discussed. In this embodiment, the casing string is identified by the numeral 16A with holes 19A therein and the rupturable plug means by 18A. Holes 19A in the section 16A include a plurality of first bores 28 transversely therein with substantially concentric and similar second bores 30 radially inwardly thereof.

Rupturable plug means 18A is characterized by a cylindrical disc or insert 32 which fits closely within first bore 28 and is disposed adjacent to a shoulder 34 extending between first bore 28 and second bore 30. Shoulder 34 prevents radially inward movement of disc 32. A retainer ring 36 holds disc 32 in place and prevents radially outward movement thereof.

Figure 4:
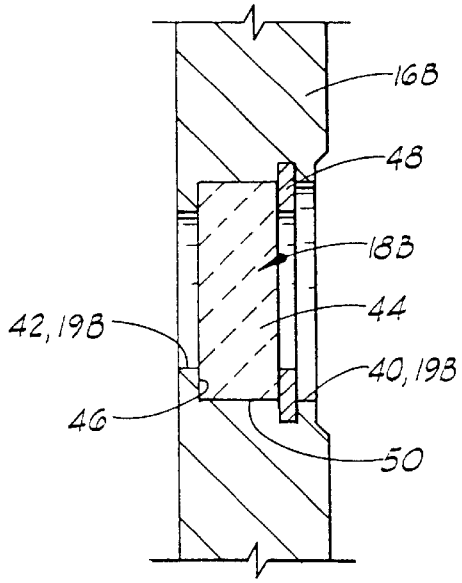
FIG. 4 is a cross-sectional enlargement showing a second embodiment.

FIG. 4 illustrates a second embodiment with casing section 16B having holes 19B therein and rupturable plug means 18B. Each hole 19B in section 16B includes a first bore 40 with a smaller, substantially concentric second bore 42 radially inwardly thereof. Rupturable plug means 18B is characterized by a substantially cylindrical disc or insert 44 which is positioned adjacent to a shoulder 46 extending between first bore 40 and second bore 42. Shoulder 46 prevents radially inward movement of disc 44. As with the first embodiment, a retainer ring 48 is used to hold disc 44 in place, preventing radially outward movement thereof.

It will be seen that the second embodiment is substantially similar to the first embodiment except that it does not use an O-ring for a sealing means. In the second embodiment, a layer of an adhesive 50 is disposed around the outside diameter of disc 44 to glue the disc in place and to provide sealing between the disc and section 16B. Adhesive may be placed along the portion of the disc which abuts shoulder 46. It will thus be seen that this adhesive assists retainer ring 48 in holding disc 44 in place and in preventing radial movement thereof.

Figure 5:
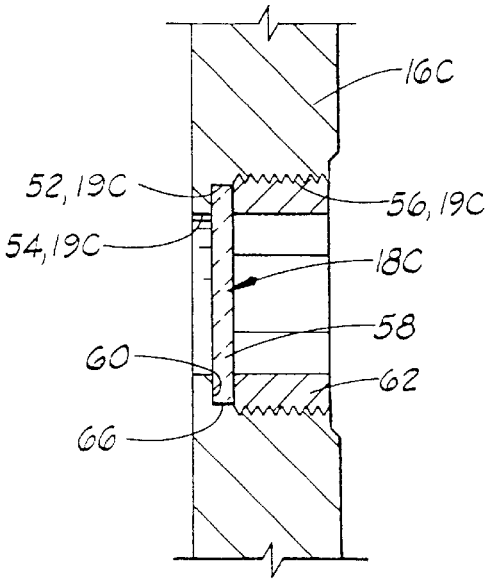
FIG. 5 represents an enlarged cross-sectional view of a third embodiment.
Figure 6:
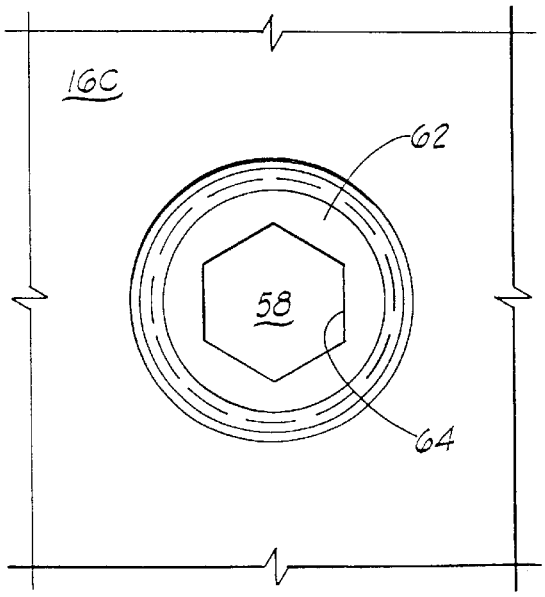
FIG. 6 is a side elevational view of the third embodiment.

Referring now to FIGS. 5 and 6, a third embodiment is shown which includes special casing section 16C having holes 19C therein and rupturable plug means 18C. Each hole 19C in section 16C includes a first bore 52 therein with a smaller, substantially concentric second bore 54 radially inwardly thereof. Each hole 19C includes a threaded inner surface 56 formed in casing section 16C radially outwardly from first bore 52.

Rupturable plug means 18C is characterized by a rupturable disc or insert 58 which is disposed in first bore 52 adjacent to a shoulder 60 extending between first bore 52 and second bore 54. Shoulder 60 prevents radially inward movement of disc 58.

Disc 58 is held in place by a threaded backup ring 62 which is engaged with threaded inner surface 56 of section 16C, thereby preventing radially outward movement of disc 58. Backup ring 62 may be formed with a hexagonal inner socket 64 so that the backup ring 62 may be easily installed with a socket wrench.

In a manner similar to the second embodiment, a layer of adhesive 66 may be disposed between disc 58 and casing section 16C to provide sealing therebetween and to assist in retaining disc 58 in place.

Figure 7:
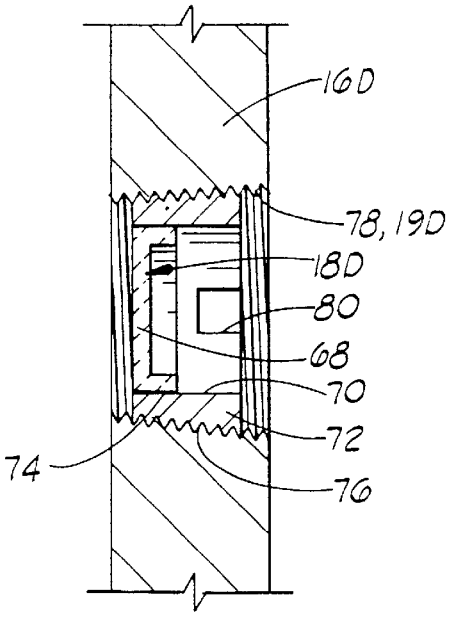
FIG. 7 shows an enlarged cross-section of a fourth embodiment of the present invention.
Figure 8:
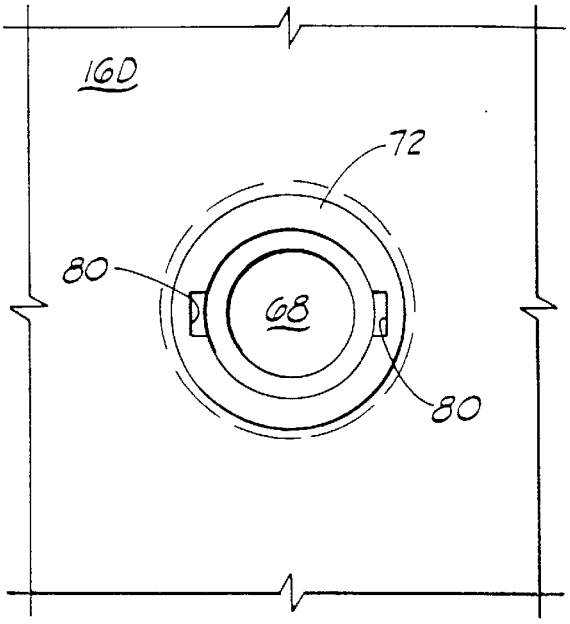
FIG. 8 is a side elevational view of the fourth embodiment of FIG. 7.
Figure 3:
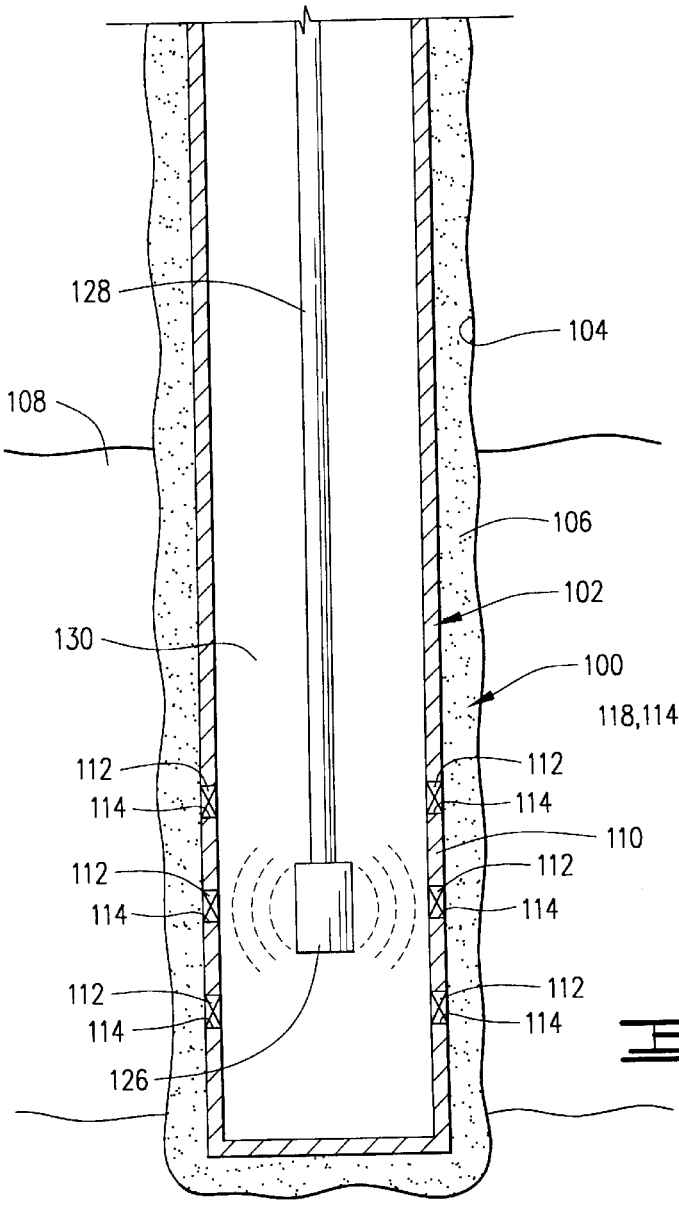
Figure 1:
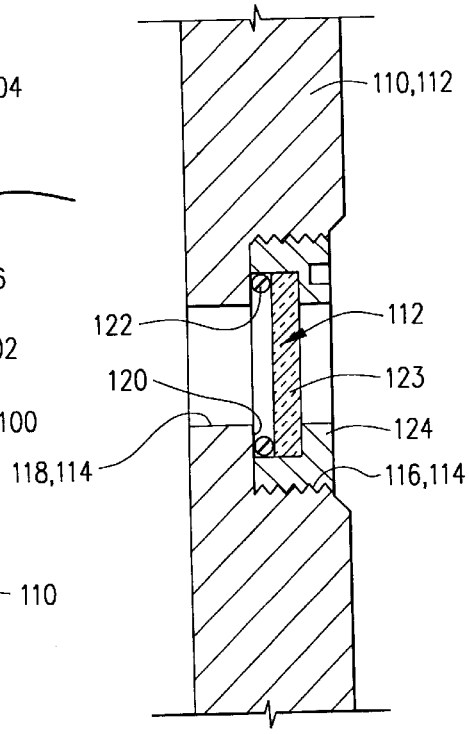

Referring now to FIGS. 7 and 8, a fourth embodiment of the invention is shown including special casing section 16D having holes 19D therein and rupturable plug means 18D. In this embodiment, a disc or insert 68 characterizes rupturable plug means 18D. Insert 68 is held by a shrink fit in a bore 70 of a case 72. A layer of adhesive 74 may be disposed around the outside diameter of insert 68 prior to shrinking case 72 thereon.

Case 72 has an outer surface 76 which is formed as a tapered pipe thread and engages a corresponding tapered pipe thread inner surface 78 which characterizes each hole 19D of casing section 16D. Thus, case 72 prevents radial movement of insert 68 in either direction.

A pair of opposite notches 80 are formed in case 72 and extend outwardly from bore 70. Notches 80 are adapted for fitting with a spanner wrench so that case 72 may be easily installed in an inner surface 78 of section 16D.

Preferably, but not by way of limitation, case 72 is made of stainless steel.

In the first through fourth embodiments, the preferred material for discs or inserts 32, 44, 58 and 68 is a ceramic. This ceramic material is provided to first withstand static differential pressure as casing string 12 is positioned in wellbore 14 and other operations prior to perforating. It is necessary to first hold differential pressure so that fluids can be displaced past the rupturable plug means 18 and into the annulus between casing string 12 and wellbore 14. At this point, it is then desired to unplug casing string section 16.

The ceramic material has sufficient strength to permit it to withstand the differential pressures, but its brittleness permits it to be removed by means of impacting with a mild explosive charge. Referring back to FIG. 1, an explosive means 82 is thus shown disposed in casing string 12 adjacent to rupturable plug means 18.

Preferably, in the first four embodiments, but not by way of limitation, this explosive means is characterized by a length of det-cord 84 connected to a detonating means such as a blasting cap 86. This assembly of blasting cap 86 and det-cord 84 may be positioned in casing string section 16 by any means known in the art, such as by lowering it into the wellbore 14 at the end of electric wire 88.

Two examples of det-cord 84 which would be satisfactory for the first four embodiments are eighty grams per foot round RDX nylon sheath cord or forty grams per foot round HMX nylon sheath cord, although other materials would also be suitable. Therefore, the invention is not intended to be limited to any particular explosive means. Preferably, det-cord 84 is positioned along the center line of casing string 12.

Upon detonation of det-cord 84, the mild explosive force will transmit a pressure wave to fracture the ceramic material in rupturable plug means 18. That is, in the first four embodiments, discs or inserts 32, 44, 58 or 68 will be fractured and thereby respectively open holes 19A–19D through the walls of corresponding casing string sections 16A–16D. This explosive force from det-cord 84 is sufficient to blow out the discs or inserts but will not cause damage to the surrounding well formation 20.

With each of the first four embodiments, rupturable plug means 18 may be installed either at a manufacturing facility or at the well site. Thus, there is great flexibility in preparing the apparatus.

Referring now to FIGS. 9 and 10, another embodiment which utilizes an acoustic or pressure wave generated other than by an explosive charge is shown and generally designated by the numeral 100. Embodiment 100 is illustrated in a gravel pack configuration, but is not intended to be limited to this particular application. Embodiment 100 comprises a casing string 102 closed at the lower end thereof and disposed in a wellbore 104. Gravel pack material 106 is disposed in the annulus between casing string 102 and wellbore 14 adjacent to the formation of interest 108. As previously described, gravel pack material 106 must not be damaged or penetrated when opening casing string 102.

Casing string 102 itself comprises a special casing string section 110 having a plurality of rupturable plug means 112 disposed in holes 114 in section 110. Section 110 is positioned in wellbore 104 such that rupturable plug means 112 are generally adjacent to well formation 108.

Referring now to FIG. 10, details of the illustrated embodiment will be discussed. Hole 114 in section 110 includes a threaded inner surface 116 and a smaller, substantially concentric bore 118. A shoulder 120 extends between bore 118 and threaded inner surface 116. Rupturable plug means 112 is characterized by a rupturable disc or insert 123 which is disposed against a sealing means, such as a seal 122, adjacent to shoulder 120. Disc 123 is held in place by a threaded backup ring 124 which is engaged with threaded inner surface 116 of hole 114, thereby preventing radially outward movement of disc 123. Backup ring 124 may be made in a manner similar to the backup rings previously described for easy installation.

The material of disc 123 is glass ceramic. This is a glass material that has been chemically treated to strengthen it so that it will withstand several thousand psi hydraulic pressure before breaking. When it does break, it shatters into numerous pieces. With a plurality of discs 123 installed, the timing of the removal of the discs 123 can be of utmost importance. Simply applying hydraulic pressure in a sustained manner will not accomplish successful removal. However, if a sudden acoustical or pressure wave is created near the discs 123 or in a manner so that the wave will propagate near the discs 123, then discs 123 can be ruptured substantially simultaneously or even selectively.

For acoustic or pressure wave embodiment 100, there are several embodiments for the operation thereof In one embodiment, identified as the fifth overall embodiment, a wave generating device 126 is positioned in section 110 adjacent to rupturable plug means 112. Wave generating device 126 is preferably located on the end of a length of fluid-filled tubing 128.

Central opening 130 of section 110 also is preferably fluid filled. The object is that, once sufficient pressure has been built up inside tubing 128, it is suddenly vented to the fluid-filled central opening 130 in section 110. This results in a pressure surge which will shatter discs 123 within several feet thereof. This process can be repeated by moving the tubing 128 to a new position and shattering additional discs 123. Some pressure wave generating devices 126 which could be used are known in the art. One such device is known as the Sperry-Sun "Negative Pulser" and is used for well operations including measurements-while-drilling (MWD). Another such device is the Halliburton "Coiled Tubing Collar Locator," disclosed in U.S. Pat. No. 5,626,192, a copy of which is incorporated herein by reference.

In a sixth embodiment, a release of a sudden pressure pulse from the surface is caused in fluid-filled tubing 128 which propagates down the tubing 128 until it reaches an area adjacent to discs 123. The pulse is then directed out the side of tubing 128 and into the fluid filling central opening 130 in section 110. One such device for this embodiment is the prior art Halliburton Pressure Pulse Generator that is used to communicate with the Halliburton Halsonics System. This device is a gas accumulator. A pneumatic valve is disposed between the accumulator and the tubing string. When control pressure is applied to the pneumatic valve, it opens allowing pressure in the accumulator to vent to the inside of the tubing, thus generating a pressure wave.

In a seventh embodiment, some pressure can be applied from the surface through known manifold techniques to pressurize the fluid in central opening 130 in section 110. This will reduce the amount of the acoustic or other pressure pulse required to shatter disc 123 using the previously described techniques of the fifth or sixth embodiments.

In an eighth embodiment, the wave generating device 126 is an acoustical horn or siren that can generate an acoustical wave in the fluid inside central opening 130 of section 110 sufficient to place the frangible material of disc 123 in a resonant state. Once the material is in this resonant state, it will shatter in a manner similar to a crystal glass placed in front of a loud speaker that is tuned to the correct frequency. Due to the dampening or attenuating effects of the fluid in section 110, the source of the acoustical wave in this embodiment is placed downhole close to disc 123. The acoustical wave is then focused and contained in such a manner as to provide optimum power and effect on the discs 123 while requiring minimum power output. Acoustical horns of this type are known in the art and some have been used in underwater applications. The horn would have to be sized to fit in the casing, of course.

As with the earlier described embodiments, rupturable plug means 112 may be installed either at a manufacturing facility or at the well site, again providing great flexibility in preparing the apparatus.

It will be seen, therefore, that the apparatus and method of removing a frangible rupture disc or other frangible device from a wellbore casing of the present invention is well adapted to carry out the ends and advantages mentioned, as well as those inherent therein. While presently preferred embodiments of the invention have been shown for the purposes of this disclosure, numerous changes in the arrangement and construction of parts in the apparatus and steps in the method may be made by those skilled in the art. All such changes are encompassed within the scope and spirit of the appended claims.

What is claimed is:

1. An apparatus for use in a wellbore comprising:

a casing string positionable in the wellbore and having a casing section defining a plurality of holes through a wall thereof;

rupturable plug means disposed in each of said holes in said casing section wherein said rupturable plug means are ruptured allowing communication between said casing string and the wellbore in response to impingement by a pressure wave without damaging areas outside said casing string; and a pressure wave generating device for generating said wave, said pressure generating device being separate from said casing string and positionable therein after said casing string is positioned in the wellbore.

2. The apparatus of claim 1 wherein said plug means comprises an insert made of a glass ceramic material.

3. The apparatus of claim 1 further comprising retaining means for retaining said plug means in said holes prior to rupturing.

4. The apparatus of claim 3 wherein said retaining means comprises a shoulder in each of said holes for preventing radially inward movement of said plug means.

5. The apparatus of claim 3 wherein said retaining means comprises a backup ring threadingly engaged with each of said holes for preventing radially outward movement of said plug means.

6. The apparatus of claim 1 further comprising sealing means for sealing between said plug means and said casing section.

7. The apparatus of claim 1 wherein:

said wave generating device is an acoustic wave generating device; and said pressure wave is an acoustic wave.

8. The apparatus of claim 7 wherein said acoustic wave generating device is an acoustical horn.

9. The apparatus of claim 7 wherein said pressure wave is transmitted through a fluid disposed in said casing section.

10. The apparatus of claim 1 wherein said wave generating device is positionable in said casing string adjacent to said plug means on a length of liquid-filled tubing.

11. The apparatus of claim 10 wherein said wave generating device is a negative pulser.

12. The apparatus of claim 10 wherein said wave generating device is a coiled tubing collar locator.

13. The apparatus of claim 10 wherein said wave generating device is a pressure pulse generator.

14. A method of opening perforations in a well casing without damaging areas outside the well casing comprising the steps of:

providing a casing string in a wellbore wherein said casing string has a section defining a plurality of rupturably plugged holes therein;

positioning a wave generating device in said casing string adjacent to said holes; and generating a pressure wave with said wave generating device wherein said pressure wave impinges on said plugged holes and ruptures and unplugs said holes without damaging areas outside said casing string.

15. The method of claim 14 wherein said step of providing a casing string comprises plugging said holes with a glass ceramic material which will rupture in response to impingement by said pressure wave.

16. The method of claim 14 wherein:

said wave generating device is an acoustic wave generating device; and said pressure wave is an acoustic wave.

17. The method of claim 16 wherein said acoustic wave generating device is an acoustical horn.

18. The method of claim 17 wherein said acoustical horn is positioned in fluid in said casing section.

19. The method of claim 18 further comprising the step of pressurizing said fluid in said casing string prior to said step of generating a pressure wave.

20. The method of claim 17 wherein:

said holes are plugged with a frangible material; and said horn generates an acoustical wave sufficient to place said frangible material in a resonant state such that said material shatters.

21. The method of claim 14 wherein said step of providing a casing string comprises filling said section of said casing string with a fluid for transmitting said pressure wave therethrough.

22. The method of claim 14 wherein said step of positioning said wave generating device comprises:

connecting said wave generating device to a length of tubing; and positioning said device in said well using said tubing.

23. The method of claim 22 wherein said tubing is liquid filled.

24. The method of claim 22 wherein said wave generating device is a negative pulser.

25. The method of claim 22 wherein said wave generating device is a coiled tubing collar locator.

26. The method of claim 22 wherein said wave generating device is a pressure pulse generator.

27. An apparatus for use in a wellbore comprising:

a casing string positionable in the wellbore and having a casing section defining a plurality of holes through a wall thereof;

rupturable plug means disposed in each of said holes in said casing section for rupturing in response to impingement by an acoustic wave; and an acoustical horn for generating said acoustic wave, said acoustical horn being separate from said casing string and positionable therein after said casing string is positioned in the wellbore.

28. A method of opening perforations in a well casing without damaging areas outside the well casing comprising the steps of:

providing a casing string in a wellbore wherein said casing string has a section defining a plurality of rupturably plugged holes therein;

positioning an acoustical horn in said casing string adjacent to said holes; and generating an acoustic wave with said acoustical horn such that said acoustic wave impinges on said holes and ruptures and unplugs said holes.

29. The method of claim 28 wherein said acoustical horn is positioned in fluid in said casing section.

30. The method of claim 29 further comprising the step of pressurizing said fluid in said casing string prior to said step of generating an acoustic wave.

31. The method of claim 28 wherein:

said holes are plugged with a frangible material; and said acoustical horn generates an acoustical wave sufficient to place said frangible material in a resonant state such that said frangible material shatters.

* * * * *